US011241806B2

(12) United States Patent
Villois et al.

(10) Patent No.: US 11,241,806 B2
(45) Date of Patent: Feb. 8, 2022

(54) TRANSVERSAL CUTTING EQUIPMENT FOR TRIMMING STRIPS

(71) Applicant: Tecnau S.r.l., Ivrea (IT)

(72) Inventors: Pier Paolo Villois, Ivrea (IT); Armando Aprato, Ivrea (IT); Giuliano De Marco, Ivrea (IT)

(73) Assignee: Tecnau S.r.l., Ivrea (IT)

( * ) Notice: Subject to any disclaimer, the term of this patent is extended or adjusted under 35 U.S.C. 154(b) by 224 days.

(21) Appl. No.: 16/038,974

(22) Filed: Jul. 18, 2018

(65) Prior Publication Data

US 2019/0022888 A1 Jan. 24, 2019

(30) Foreign Application Priority Data

Jul. 18, 2017 (IT) ..... 102017000081301

(51) Int. Cl.
*B26D 7/18* (2006.01)
*B26D 1/38* (2006.01)
(Continued)

(52) U.S. Cl.
CPC ..... *B26D 7/1863* (2013.01); *B26D 7/018* (2013.01); *B26D 9/00* (2013.01); *B26F 1/02* (2013.01); *B26F 1/08* (2013.01); *B26F 1/14* (2013.01); *B41F 13/58* (2013.01); *B26D 1/385* (2013.01); *B26D 2007/0068* (2013.01); *Y10T 83/207* (2015.04)

(58) Field of Classification Search
CPC ..... B26D 9/00; B26D 3/385; B26D 7/018; B26D 7/1863; B26D 2007/068; B26F 1/08; B26F 1/02; B26F 1/14; B41F 13/58; Y10T 83/207
USPC ..... 83/100
See application file for complete search history.

(56) References Cited

U.S. PATENT DOCUMENTS 3,166,965 A * 1/1965 Stemmler ..... B26D 7/2628 83/175
3,670,612 A * 6/1972 Johnson et al. ..... B26D 7/015 83/99
(Continued)

FOREIGN PATENT DOCUMENTS

DE 1 561 520 A1 * 4/1970 ..... B26F 1/14
DE 40 23 257 A1 * 1/1992 ..... B26D 7/1863
(Continued)

OTHER PUBLICATIONS

Jun. 15, 2018—(IT) Italian Search Report—App 10201700081301.

*Primary Examiner* — Clark F Dexter
(74) *Attorney, Agent, or Firm* — Banner & Witcoff, Ltd.

(57) ABSTRACT

A cutting equipment which trims strips of webs in movement includes a stationary trimming blade and a rotating cylinder with a mobile trimming blade; the rotating cylinder includes a sector with suction openings connected to a vacuum source, which retains the strips by suction and drags the strips up to a strip collector; the cutting equipment cuts and separates transversal strips of two webs overlapped in adherence jointly to the cutting of basic sheets; a perforating device perforates a row of holes on the first web adjacent to an edge of the sheets; and a first web is positioned with the row of holes in front of the suction openings, while the strip of the second web is retained and dragged by suction through the holes of the first web up to the strip collector.

18 Claims, 9 Drawing Sheets

(51) Int. Cl.

| | |
|---|---|
| ***B26D 9/00*** | (2006.01) |
| ***B26F 1/02*** | (2006.01) |
| ***B26F 1/08*** | (2006.01) |
| ***B26F 1/14*** | (2006.01) |
| ***B41F 13/58*** | (2006.01) |
| ***B26D 7/01*** | (2006.01) |
| *B26D 7/00* | (2006.01) |

(56) References Cited

U.S. PATENT DOCUMENTS

| | | | | |
|---|---|---|---|---|
| 3,847,045 | A | 11/1974 | Willhite, Jr. et al. | |
| 5,140,880 | A * | 8/1992 | Littleton | B26D 7/1863 83/100 |
| 5,609,084 | A * | 3/1997 | Gronbjerg | B26D 1/385 83/100 |
| 2003/0159558 | A1 * | 8/2003 | Takayama | B26D 7/1854 83/100 |
| 2013/0000458 | A1 * | 1/2013 | Ueda | B26D 7/018 83/367 |

FOREIGN PATENT DOCUMENTS

| | | | | |
|---|---|---|---|---|
| DE | 40 25 518 | C1 * | 1/1992 | B26F 1/14 |
| DE | 42 29 699 | A1 * | 3/1994 | B26D 7/1863 |
| WO | 2009022053 | A1 | 2/2009 | |
| WO | WO-2009/122593 | A1 * | 10/2009 | B26D 7/018 |

* cited by examiner

TRANSVERSAL CUTTING EQUIPMENT FOR TRIMMING STRIPS

RELATED APPLICATION

This application claims priority to Italian Application No. 102017000081301 filed on Jul. 18, 2017 and entitled "Equipment and method of transversal cutting for trimming strips", the content of which is incorporated herein by reference in its entirety.

FIELD OF THE INVENTION

The present invention relates to an equipment and a method of transversal cutting for trimming strips of moving webs.

More specifically the invention relates to a transversal cutting equipment for trimming strips of webs moving along a given direction, comprising: a stationary fixed trimming blade, a trimming blade carrying cylinder rotatably mounted around a rotating axis and supporting a movable trimming blade, a vacuum source, and a collector for the trimmed strips.

According to a typical technology, the web arriving from printers is cut by suitable cutting apparatuses for subsequent processing on line, or is wound in rolls from which the web is then unwound off-line and cut in movement. This, with a speed of the web more than 400 m/min for a high operative productivity.

BACKGROUND OF THE INVENTION

With the cutting of the web, various sheets with single or multiple images are thereby separated for following processing. However, the thus cut sheets generally have defects dependent on the printer or on the printing processes and/or cutting. These defects, aesthetically unacceptable, may be constituted by torn out parts, parts with prints or service codes of the printer and, in the case of ink jet printers, bleed areas for the bleeding of the heads. The cutting or separation of the sheets from the web does not eliminate the defects, making it necessary a trimming cut for removing a small strip of web constituted by the torn out or bleed area or of a width sufficient to cover the area to be removed.

In this framework, the equipments of transverse cutting and removal for trimming strips of webs have an important role. According to a typical structure, these equipments comprise a fixed trimming blade, a blade carrying cylinder mounted for rotation about an axis of rotation and supporting a movable blade, a source of vacuum, and a collector for the trimmed strips. With the rotation of the blade carrying cylinder, the movable blade cooperates with the fixed blade for separating the strips, while a retaining sector of the cylinder adjacent to the blade retains the strips by suction, by means of suction openings connected to the vacuum source, and drags the strips from the area of the cut up to the collector for the trimmed strips.

The structure for retaining the trimming strips by suction is associated with complex and costly devices if the strips should be cut and removed from continuous paper forms that are overlapping. Such webs are derived from webs of width double with respect to the width of the sheet to be produced and are cut longitudinally and overlapped in suitable apparatuses, for optimizing printing costs and productivity.

SUMMARY OF THE INVENTION

A general object of the present invention is to provide a cutting equipment and method for trimming strips of moving webs which can process overlapped continuous paper forms, ensuring a high productivity, and which are reliable and of relatively low cost.

This object is achieved by the equipment of cutting for trimming strips for overlapped webs of the above specified type, with the use of a holing mechanism for transversal perforations and in which a first web is arranged in use in front of a trimming blade carrying cylinder. The holing mechanism is operable for executing a row of transversal holes on the first web adjacent to a respective edge of separation and wherein the row of holes can be positioned in front of the suction openings in association with the cuts for a suction action also on the second web, and the suction action is such as to retain overlapped webs in adherence on the retaining sector such that the strip of the second web is in adherence on the strip of the first web during the cutting and the dragging of the strips up to the strip collector.

The method for trimming strips of the invention uses an equipment comprising: a fixed trimming blade, a trimming blade-carrying cylinder rotating around a rotating axis for supporting a movable trimming blade, a vacuum source, and a strip collector. The equipment is associated with a separating transversal cutting device for executing transversal separation edges on the webs and the movable trimming blade is provided for cooperating with the fixed trimming blade for separating adjacent strips adjacent to the transversal separation edges. The trimming blade-carrying cylinder includes a retaining sector, adjacent to the movable trimming blade, having a plurality of suction openings connected to the vacuum source for retaining the strips by suction, and dragging said strips up to the strip collector, and wherein the equipment further comprises a holing mechanism for effecting holes transversely on one of the webs. Said method applies to the cutting and separation of trimming strips of two webs overlapped in adherence and comprises the following steps:

a) holing a first web disposed in front of the trimming blade carrier cylinder, with a row of holes adjacent to a respective edge of the separation edges;
b) positioning the row of holes in front of the openings in association with the cuts for a suction action also on the second web; and
c) executing a suction action such to retain overlapped and in adherence, on the retaining sector, the strips of the first web and the strips of the second web during cutting and dragging up to the strip collector.

BRIEF DESCRIPTION OF THE DRAWINGS

The characteristics of the invention will become clear from the following description, given purely by way of non-limiting example, with reference to the appended drawings in which.

DETAILED DESCRIPTION OF THE PREFERRED EMBODIMENTS

First Example Embodiment of the Invention

Figure 1:
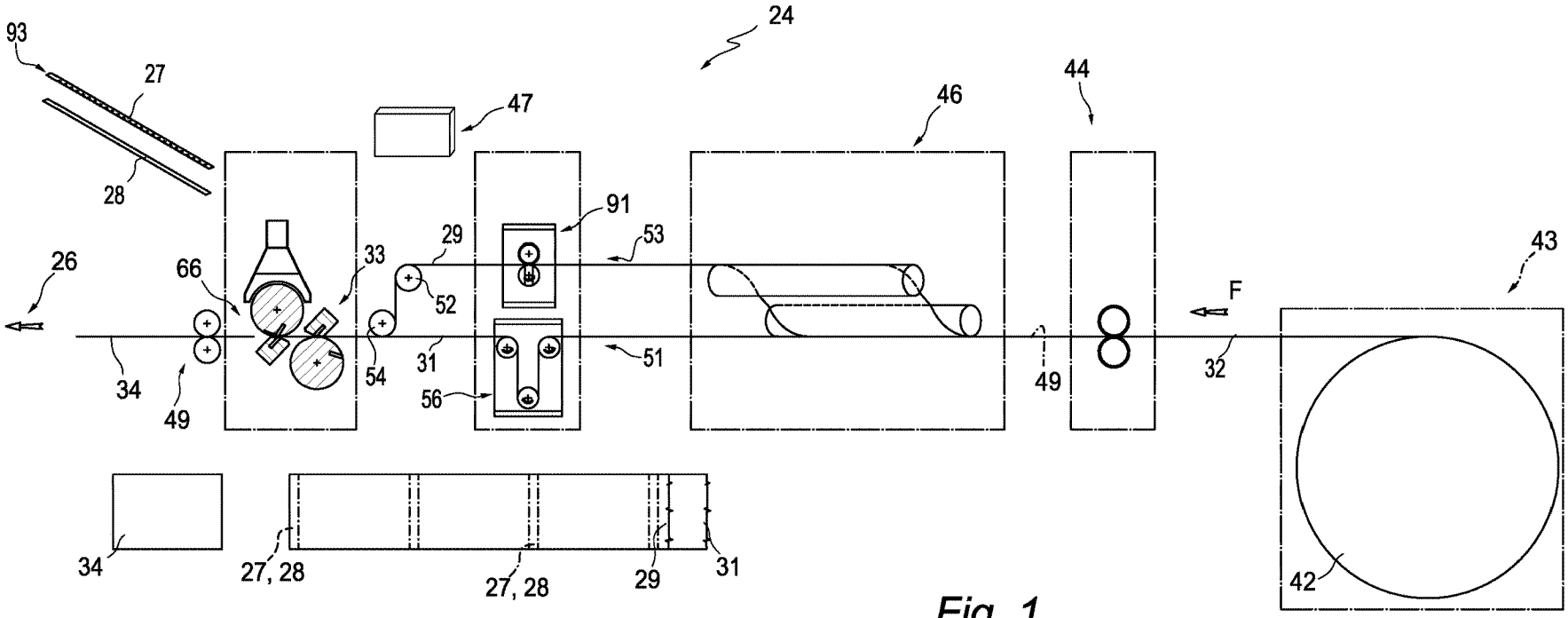
FIG. 1 represents a schematic side view of a transversal cutting equipment for trimming strips of moving webs, in accordance with a first example embodiment of the invention.
Figure 2:
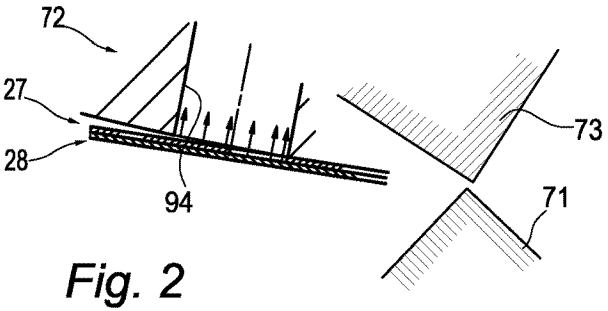
FIG. 2 shows schematically a section at a very large scale of some details of the equipment of FIG. 1.

FIG. 1 shows a transversal cutting equipment 24 for trimming strips of webs or continuous paper forms in movement, in accordance with a first example embodiment of the invention. The equipment 24 feeds with trimmed sheets a system for the automatic processing of documents, the system generally designated by reference numeral 26.

The transversal cutting equipment 24 is used for cutting and separating trimming strips 27 and 28 of two webs 29 and 31. The webs 29 and 31 are overlapped in adherence and are derived by longitudinally cutting and merging from an original web 32 in movement, according to a two-up technique. As described below, the sheets are separated by a transversal cutting apparatus 33 and the equipment 24 operates in combination with the cutting apparatus 33 for trimming the overlapped sheets as trimmed sheets for the system 26.

Figure 4:
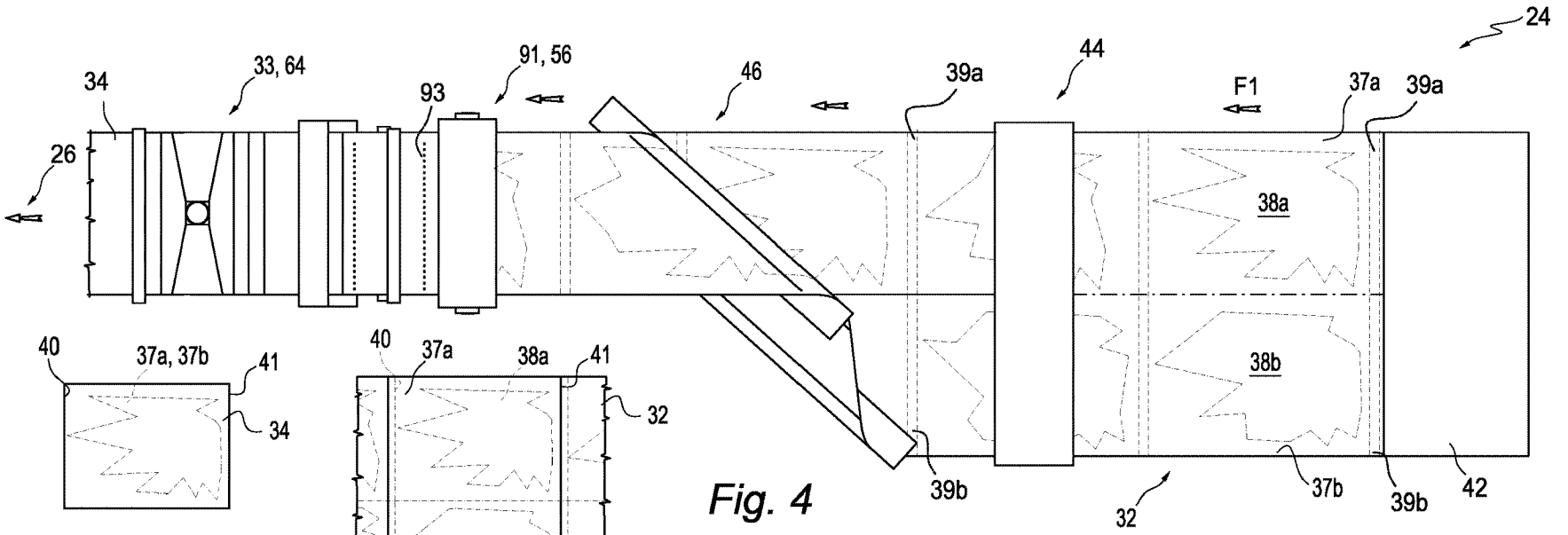
FIG. 4 shows a schematic plan view of the cutting equipment of FIG. 1.
Figures 8, 9, 9A, 9B, 9C:
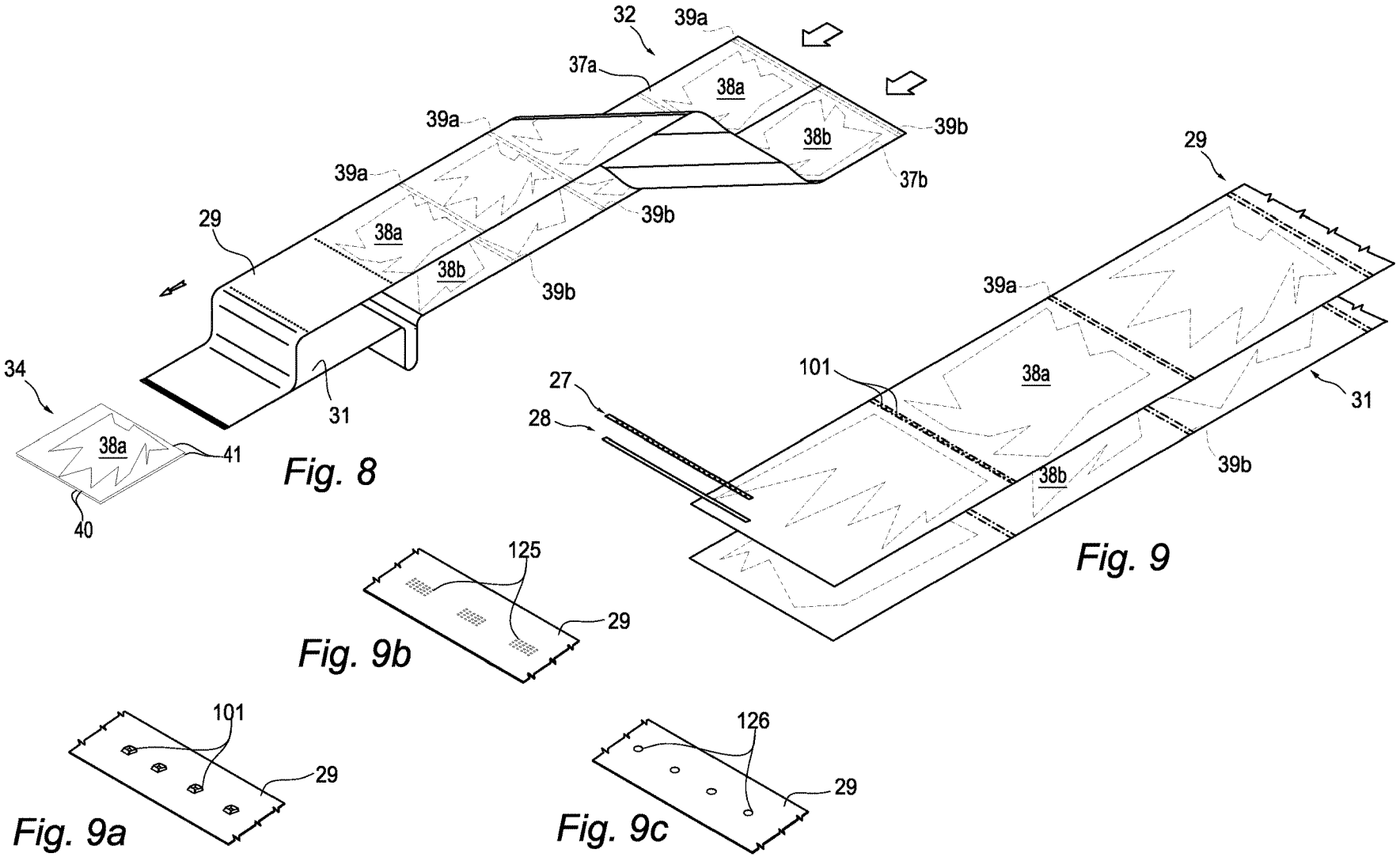
FIG. 8 shows a schematic view of a part of the strip treated by the cutting equipment for trimming strips of FIG. 1.
FIG. 9 shows a schematic view of some details of the web of FIG. 8.
FIG. 9*a* is a schematic view at an enlarged scale of a section of the web of FIG. 8.
FIGS. 9*b* and 9*c* are schematic views, at enlarged scale, of variants of the section of the web of FIG. 9*a;*

The original web 32 (FIGS. 4 and 8) defines basic sheets 37*a* and 37*b* with respective images 38*a* and 38*b*, printed digitally, and arranged in sequence along two rows side by side and intended to generate the trimmed sheets 34. Between the images in sequence 38*a* and 38*b* there are separating areas 39*a* and 39*b* with defects aesthetically unacceptable for the sheets intended to the system 26 for the automatic processing of documents. The equipment 24 removes these areas with the trimming strips 27 and 28 from initial portions of the basic sheets 37*a* and 37*b* so as to form clean leading edges 40 and trailing edges 41 of the trimmed sheets 34. The defects can be constituted by torn out edges, marginal portions of the sheets with service prints or codes of the printer and, in the case of ink jet printers, areas of bleed for the bleeding of the heads.

In the following description, the transversal cutting equipment 24 operates off-line from a printer, not shown, that generated the images 38*a* and 38*b* and in which the web 32, after the printing, has been wound into a reel 42. The cutting equipment of the invention can, however, also operate on-line on the web 32, downstream of the printer for the images 38*a* and 38*b*.

The transversal cutting equipment 24 is associated to an unwinding device 43, to a longitudinal cutting and overlapping group including a longitudinal cutting device 44 and to a deviating device 46. The unwinding device 43 unwinds the web 32 from the reel 42 and whereas the cutting device 44 divides the web 32 longitudinally side by side forming the webs 29 and 31 on a geometrical plane 49.

The movements occur, at high speed and by means of not shown mechanisms, along a direction of movement "F" parallel to a longitudinal axis of the web 32. The deviating device 46 provides to divert the first web 29 upwards from the condition of side by side with the web 31 to a condition of alignment and offset in height with respect to the web 31 on a geometrical plane 50 higher with respect to the plane 49. The web 31 proceeds along a direct path 51 on the plane 49, while the web 29 proceeds with support on an upper roller 52 along a deviated path 53, on the higher plane 50 and in condition of parallelism with the path 51. Then, a lower support roller 54 deflects the web 29 from the upper support roller 52 downwards and to the geometrical plane 49 and on a condition of overlapping and adherence with respect to the web 31 along the plane 49 with the cooperation of a counter roller 55.

Figure 11:
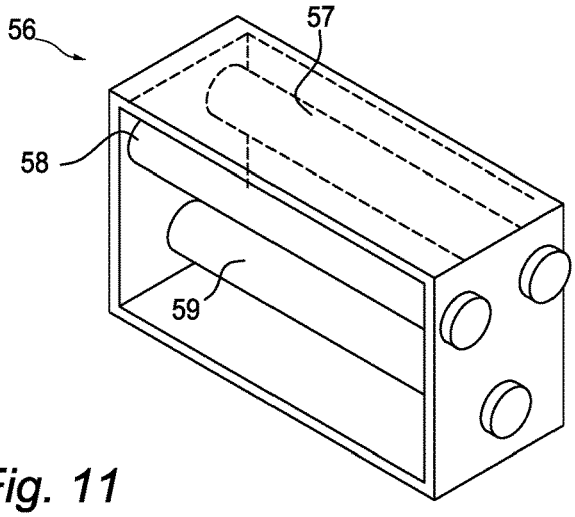
FIG. 11 is a schematic view of another component of the equipment of FIG. 1.

To the transversal cutting equipment 24 is also associated a compensating mechanism 56 (FIGS. 1 and 11) operating on the web 31. The mechanism 56 is provided for compensating the difference in length of the portions of the webs between the deviated path 53 of the web 29 and the direct path 51 of the web 31 for a correct alignment of the basic sheets 37*a* and 37*b* in front of the transversal cutting apparatus 33. The mechanism 56 is arranged upstream of the lower roller 54 and the counter-roller 55 and comprises two upper support rollers 57 and 58 and a lower support roller 59. The upper rollers 57 and 58 support the web 31 on the plane 49, while the lower roller 59 is arranged in an intermediate position below the rollers 57 and 58 and defines a loop 60 for the web 31.

The transversal cutting apparatus 33 is arranged downstream of the lower roller 54 and the counter roller 55 and is operable for cutting together the webs 29 and 31 and separating the aligned basic sheets 37*a* and 37*b* with definition of the trailing edges 41 of the trimmed sheets 34.

The cutting apparatus 33 comprises a fixed edge blade 62, substantially stationary, and an edge blade carrying cylinder 63 with a movable edge blade 64 arranged below and, respectively, above the plane 49. The edge blade 62 and the edge blade carrying cylinder 63 are arranged transversely to the direction of movement "F", while the overlapped webs 29 and 31 follow a cutting path in a space between the blade 62 and the cylinder 63.

The rotation of the edge blade carrying cylinder 63 is synchronized with the movement of the webs 29 and 31 under the control of the electronic unit 47 in such a way as to carry out the cutting of the edges 40, 41 of the basic sheets on the passage of the movable blade 64 against the fixed blade 62 in a manner known per se.

For separating the strips, the equipment 24 includes, downstream and close to the transversal cutting apparatus 33, a trimming apparatus 66 comprising a fixed trimming blade 71 and a trimming blade carrying cylinder 72 supporting a movable trimming blade 73. The blade carrying cylinder 72 is arranged above the geometrical plane 49, while, respectively, the fixed trimming blade 71 is arranged below the plane 49.

The trimming blade carrying cylinder 72 is mounted for rotation on an axis of rotation parallel to the axis of the cylinder 63 and is controlled by the electronic unit 47 for executing a trimming cut on the webs 29 and 31 on the passage of the movable trimming blade 73 in contrast with the fixed trimming blade 71.

The trimming apparatus 66 also comprises a vacuum source 74, a compressed air source 76 and a strip collector 77. The trimming blade carrying cylinder 72 includes a retaining sector 78 adjacent to trimming blade 73 and has a series of suction openings 79 on the sector 78 and an axial duct 81 connected with the openings 79.

The trimming blade carrying cylinder 72 cooperates at one end with a rotating shutter 82 for connecting the duct 81 to the vacuum source 74 or with the compressed air source 76 as a function of the angular position of the trimming blade carrying cylinder 72. The strip collector 77 is disposed above the cylinder 72 and is also connected to a vacuum source for the collection of previously separated trimming strips.

According to the known art, the retaining sector 78 exerts a suction action and a retaining action on a position of the webs adjacent to the cut and an ejection action for a position in front of the strip collector 77. For a typical, non limitative use, the electronic unit 47 controls the rotation of the trimming blade carrying cylinder 72 so as to trim trimming strips of 4-25 mm of width.

In accordance with the invention, the webs 29 and 31 are kept in adherence, downstream of the transversal cutting apparatus 33 and along a cutting path passing between the fixed trimming blade 71 and the trimming blade carrying cylinder 72 for a simultaneous cutting of the two webs. In use, the web 29 therefore has a lower face 83 adhering to the web 31 and an opposite face 84 facing the trimming blade carrying cylinder 72, while the web 31 has an upper face adherent to the web 29 and an opposite lower face facing the fixed trimming blade 71.

Cutting and separation of the trimming strips 27 and 28 of the webs 29 and 31 are carried out in a condition of overlapping and adherence by suction on the retaining sector 78 through holes on the web 29 facing the cylinder 72.

To this end, the transversal cutting equipment 24 comprises a holing mechanism including, for example, a perforating device 91 which can be activated by the electronic control unit 47 for executing a row of holes constituted by transversal perforations 93 on the first web 29, upstream and adjacent to a trailing edge 41 of separation for the trimmed sheets 34.

In association with the trimming cut, the strip 27 with the row of perforations 93 can be positioned in front of the suction openings 79 of the retaining sector 78 for a suction action which is exerted also on the second web 31. The suction action is such as to retain in overlapping and adherence on the sector 78 the strips 27 of the web 29 and the strips 28 of the web 31 in overlapping and adherence on the strips 27 during the cutting and the dragging of the strips up to the strip collector 77. In known manner the strips are ejected from the retaining sector 78 by means of a jet of compressed air through the suction openings 79, collected by suction by the collector 77 and transported in a not shown container.

Figure 3:
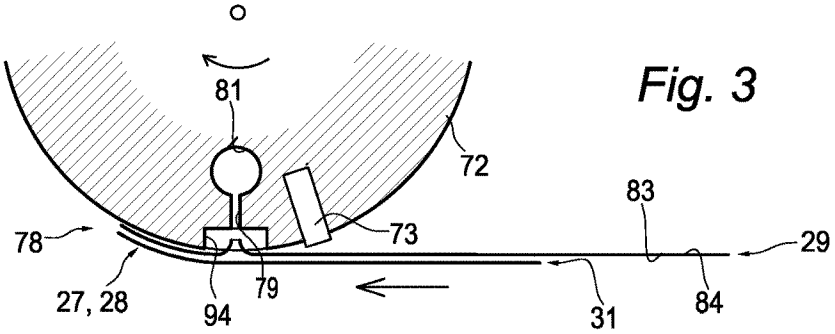
FIG. 3 is a section at an enlarged scale of details of FIG. 1.

For a more efficient suction action, the trimming blade carrying cylinder 72 (FIG. 3) defines, along a generatrix, a longitudinal groove 94 in the retaining sector 78. The suction openings 79 are arranged along the groove 94, which is substantially aligned with the row of perforations 93 during the cutting of the strips 27 and 28.

Conveniently, the perforating device 91 operates with perforating elements acting on the face 83 of adherence of the web 29 with the retaining sector 78. In this way, bends and burrs normally caused by the perforation, in use, face toward the groove 94 of the retaining sector for a plain contact and sealing of the strip on the retaining sector 78. According to a non limiting example, the groove 94 has a width of 2-4 mm, typically 3 mm, and a depth of 0.1-0.8 mm.

Figure 5:
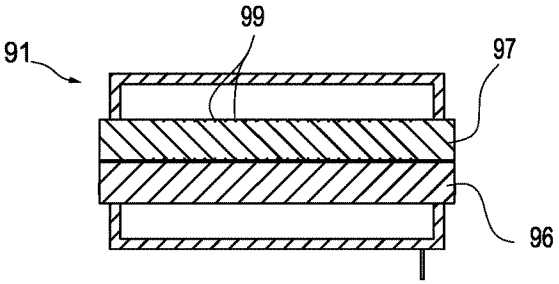
FIG. 5 is a schematic front section at an enlarged scale of a component of the cutting equipment of FIG. 1.
Figure 5B:
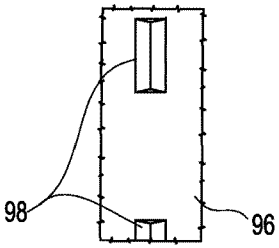
FIGS. 5*a* and 5*b* show, at an enlarged view, a section and a view of some details of the component of FIG. 5.
Figure 5A:
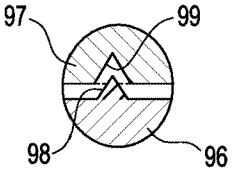
Figures 6, 7:
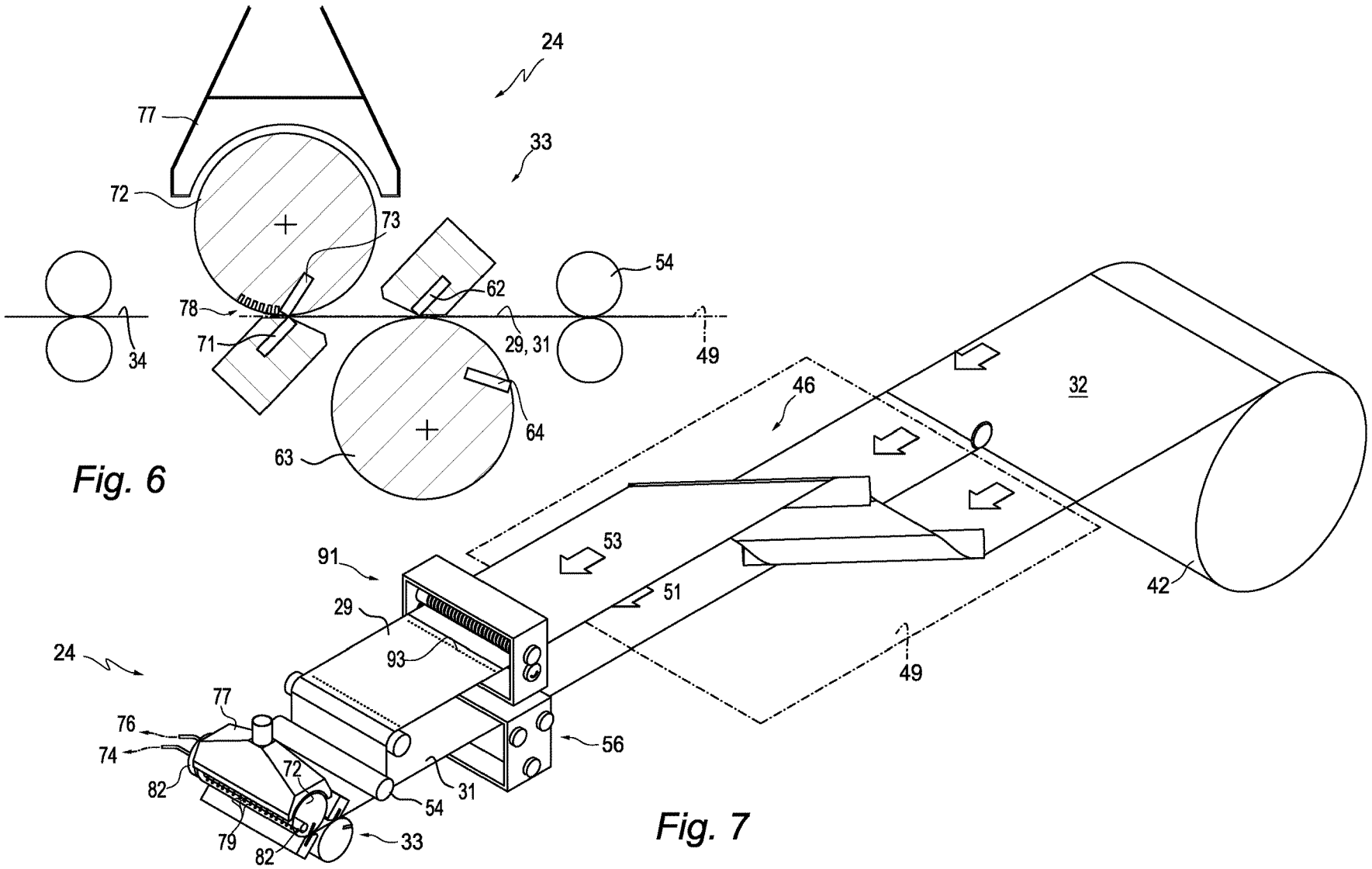
FIG. 6 represents a schematic section of some components of the cutting equipment for trimming strips of FIG. 1.
FIG. 7 shows a schematic view of the cutting equipment in accordance with the first example embodiment of the invention.

The perforating device 91 (FIG. 1) is arranged along the deviated path 53 of the web 29, partially in the space between the planes 49 and 50 and comprises, in vertical alignment, a lower tooth carrying support 96 (FIGS. 5, 7 and 10) and an upper contrast roller 97. The tooth carrying support 96 and the roller 97 are rotatably mounted on respective rotation axes parallel to each other and transversal to the direction of movement "F" of the web 29 and define a space for the passage of the web 29. The tooth carrying support 96 is of parallelepiped shape of limited thickness and includes on each edge a row of perforating teeth 98 parallel to the axis of rotation, while the contrast roller 97 defines annular grooves 99 associated to the row of teeth 98.

By way of a non limitative example, the perforation teeth 98 are made from a blade of 1.0-2.5 mm of thickness with a pitch of about 3-5 mm and a width of the teeth at the base of 2.0-3.5 mm, for perforations 93 of quadrangular shape of 0.8 to 1.5 mm and pitch of 3-5 mm.

The tooth carrying support 96 is rotated by a servomechanism controlled by the electronic unit 47 for executing, on the fly, the transversal perforations of the first web 29 at predetermined distances along the direction "F" from the edge of separation of the sheets. The perforation teeth 98 can also be of elongated shape, parallel to the axis of rotation of the support 96 for obtaining perforations 101 with a greater section of suction, in use, toward the web 31.

Figure 13:
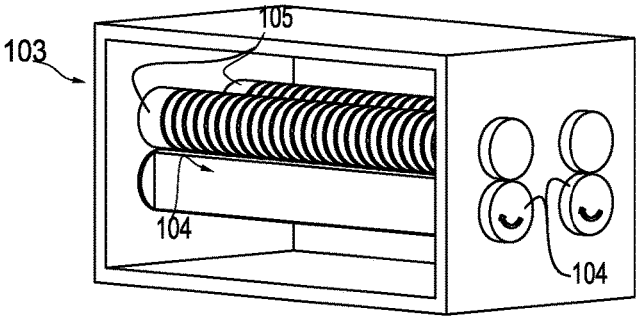
FIG. 13 is a schematic view of a component of transversal cutting equipment, in accordance with the variant of the invention of FIG. 12.
Figure 14:
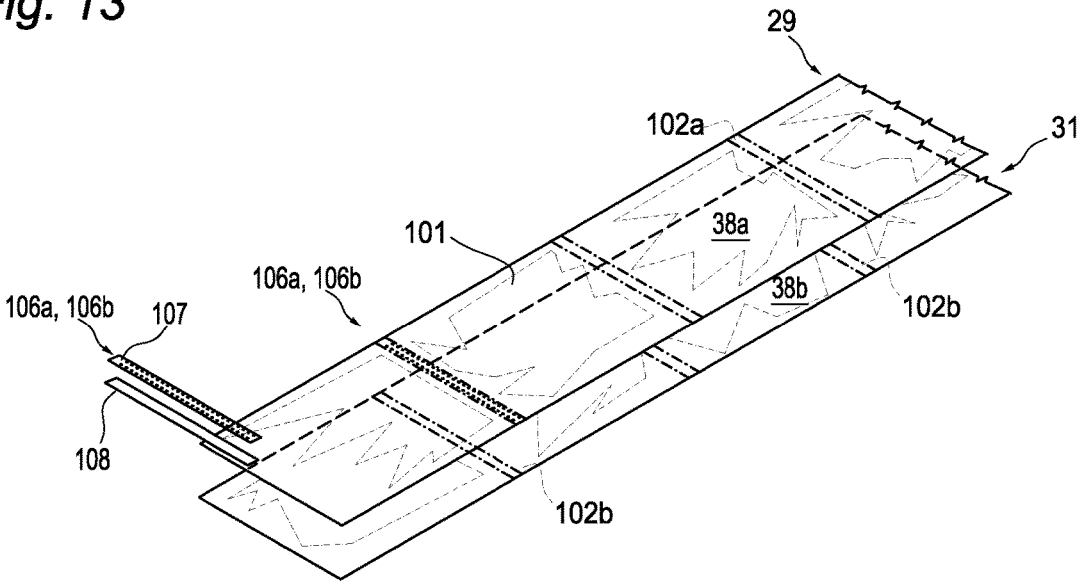
FIG. 14 is a schematic view of a part of the web treated by the cutting equipment, in accordance with the variant of FIG. 12.
Figure 14A:
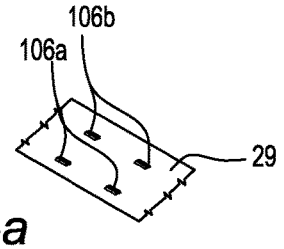
FIG. 14*a* shows a schematic view, at an enlarged scale, of a section of the web of FIG. 14.

In the case of webs 29 and 31 with extended separation areas 102*a* and 102*b* (FIG. 14), the equipment 24 comprises a perforating device 103 (FIG. 13) with two tooth carrying supports 104 and two contrast rollers 105. This for executing two flanked rows of transversal perforations 106*a* and 106*b* (FIGS. 14 and 14*a*) for the areas 102*a* and 102*b* and corresponding trimming strips 107 and 108, so as to obtain an appropriate action of suction on the second web 31. In an alternative, the two rows of perforations 106*a* and 106*b* can be obtained by a double actuation of the perforating device 91.

As other alternative for the double perforation, the transversal cutting equipment 24 provides, in the perforating device 91, a tooth carrying support 110 (FIG. 10*b*) with a double row of teeth in lieu of the support 96, when this is deemed appropriate. In detail, the support 110 mounts on each edge two rows of perforation teeth 98*a* and 98*b* parallel to the axis of rotation of the support 110 and at a distance associated to the one of the rows of transversal perforations 106*a* and 106*b*. In use, the two rows of teeth perform on the web 29 the perforations 106*a* and 106*b* at their passage in front of the annular grooves 99.

Figure 12:
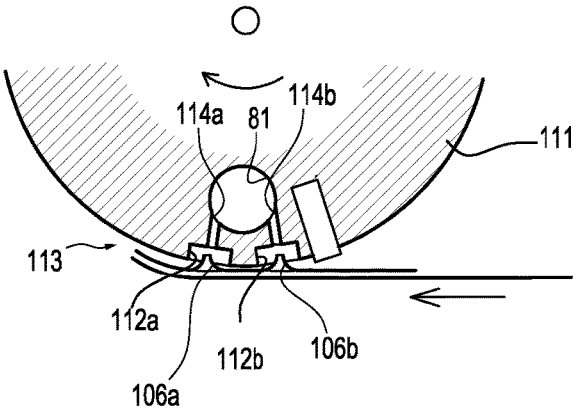
FIG. 12 is a schematic section of a component of the transversal cutting equipment, in accordance with a variant of the invention.

For processing the webs 29 and 31 with double perforation on the web 29, a trimming blade carrying cylinder, represented with 111 in FIG. 12, comprises two longitudinal grooves 112*a* and 112*b* in a retaining sector 113. In the grooves 112*a* and 112*b* are corresponding suction openings 114*a* and 114*b*, connected to the axial duct 81 and which, in operating conditions, are substantially aligned with the rows 106*a* and 106*b*. Also the perforating device 103 operates with perforating elements acting on the face 83 of adherence of the web 29 for bends and burrs facing, in use, toward the grooves 112*a* and 112*b*. The trimming of the strips 107 and 108 (FIG. 14) is effected in a way similar to the one described for the trimming strips 27 and 28.

Figure 10:
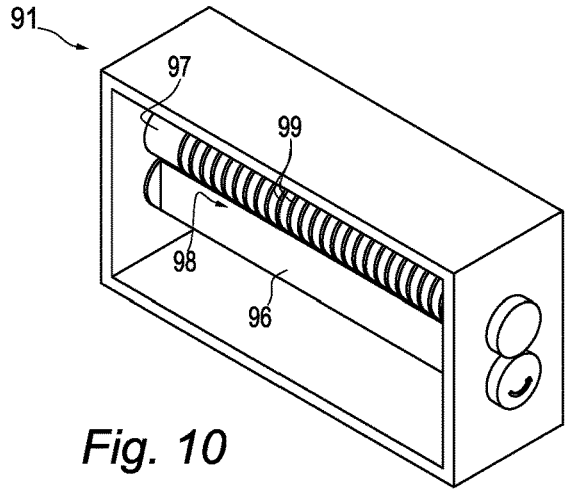
FIG. 10 is a schematic view of a component of the equipment of FIG. 1.
Figure 10A:
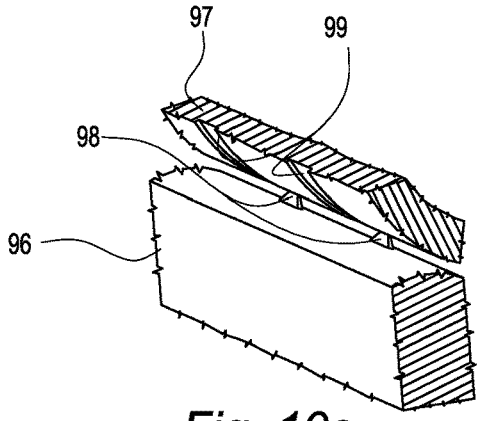
FIG. 10*a* is a diagrammatic section at an enlarged scale of the component of FIG. 10.
Figure 10B:
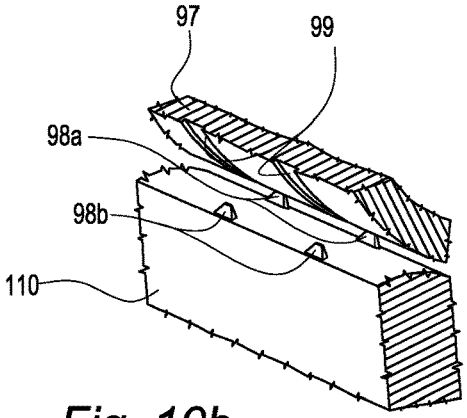
FIG. 10*b* shows a diagrammatic section, at an enlarged scale, of the component of FIG. 10, in accordance with a variant of the invention.

In alternative, the holing mechanism of the transversal cutting equipment 24 of the invention includes a device for micro-perforations, not shown in the drawings, similar to the perforating device 91 of FIG. 10, comprising a support for a series of needles or teeth for micro-perforations and a contrast roller for the needles or the teeth. The support for the needles or teeth is servo-controlled by the electronic unit 47, while the contrast roller has a peripheral speed synchronous with the feeding speed of the web 29. The needles or the teeth are distributed in rows and columns on the respective support for executing, on the fly, transversal micro-perforations 125 (FIG. 9*b*) with the same function of improved suction of the perforations 93.

The teeth for the micro-perforations can be formed of 4-5 juxtaposed blades of 0.3 mm of thickness, alternated with blades without teeth of the same thickness, in groups of 4-6 teeth, and pitch of about 15 mm, for micro-perforations 125, purely indicative, of 0.2×0.6 mm, in areas of 2.5×6.0 mm and a pitch of 15 mm.

As another alternative, the holing mechanism of the cutting equipment 24 comprises a punching device, not shown, similar to the perforating device 91 with a punch holder support for a row of punches and a die support roller for respective dies. The punch holder support and the die support roller are servo-controlled by the electronic unit 47 for executing, on the fly, transversal punch holes 126 (FIG. 9*c*) on the web 29. An aspirating element, not shown, is associated to the punching device for collecting the scraps separated by the punching operation. The punches are cylindrical and have a cutting diameter of 1.5-3 mm, typically 2.5 mm with pitch of 10-20 mm, typically 15 mm for punches of the same diameter and the same pitch.

The alternative solutions with the micro-perforations or with the punches can be applied also to the webs 29 and 31 with extended separation areas, adopting solutions similar to those described for the perforations.

Figure 15:
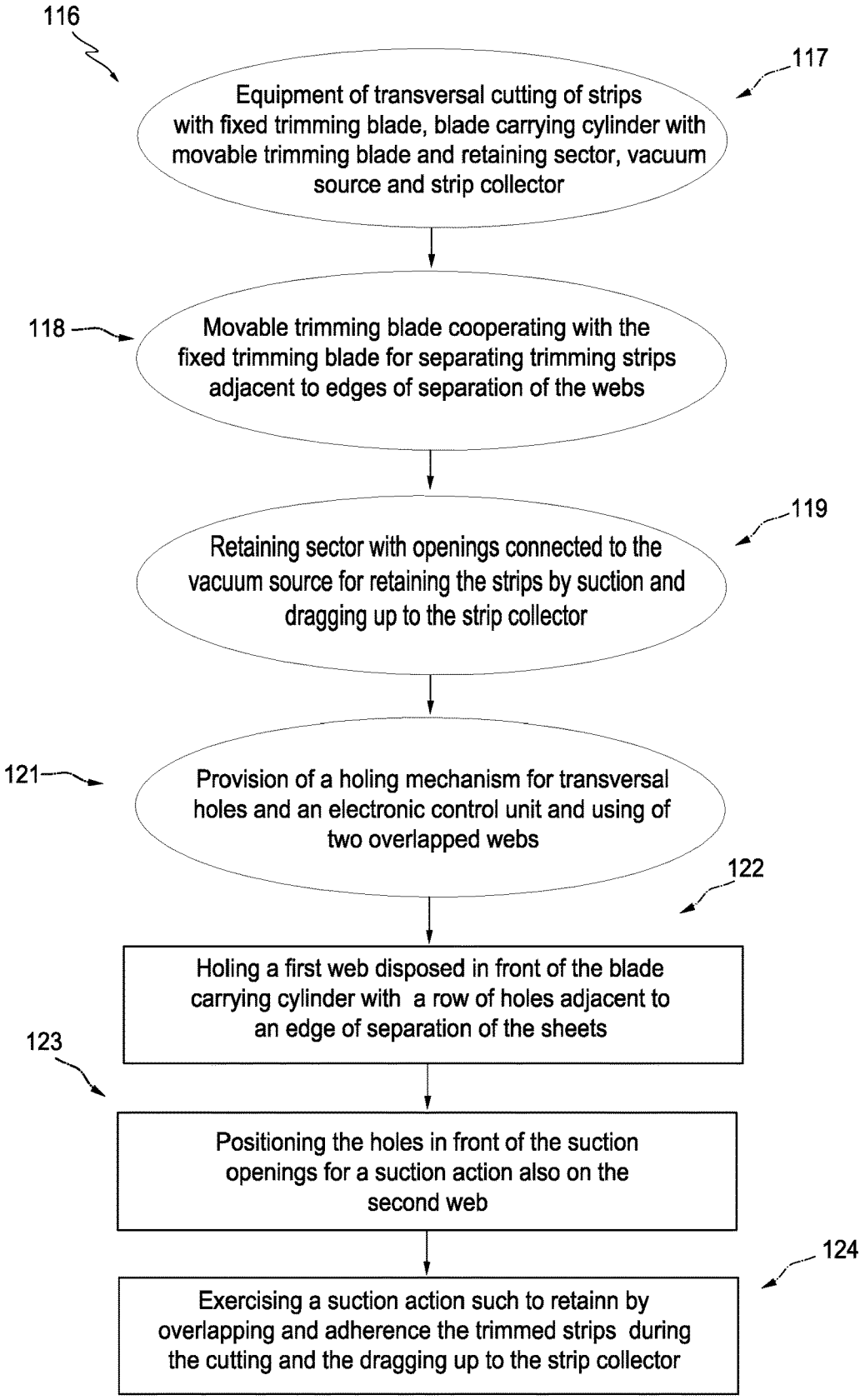
FIG. 15 represents a flow chart of the method of cutting for trimming strips in accordance with the invention.

The method of cutting for trimming strips of the invention is represented by 116 in the flowchart of FIG. 15. The method 116 provides the use of a cutting equipment, condition 117 comprising a fixed trimming blade, a trimming blade carrying cylinder, rotating about an axis of rotation, of support for a movable trimming blade, a vacuum source, and a strip collector. The movable trimming blade cooperates with the fixed trimming blade for separating trimming strips adjacent to edges of separation of the webs, condition 118. The retaining sector has a series of suction openings connected to the vacuum source to retain the strips by suction and draw the strips up to the strip collector, condition 119.

The method 116 employs a holing mechanism for transversal holes and an electronic control unit, and it is used for cutting and separating trimming strips of two webs overlapped in adherence, condition 121 and comprises the following steps:

a) holing a first web disposed in front of the trimming blade carrier cylinder, with a row of holing adjacent to a respective edge of the separation edges, block 122;
b) positioning the row of holes in front of the openings in association with the cuts for a suction action also on the second web, block 123; and
c) exerting a suction action such to retain overlapped and in adherence, on the retaining sector, the strips of the first web and the strips of the second web during the cutting and the dragging up to the strip collector, block 124.

Second Example Embodiment of the Invention

Figure 16:
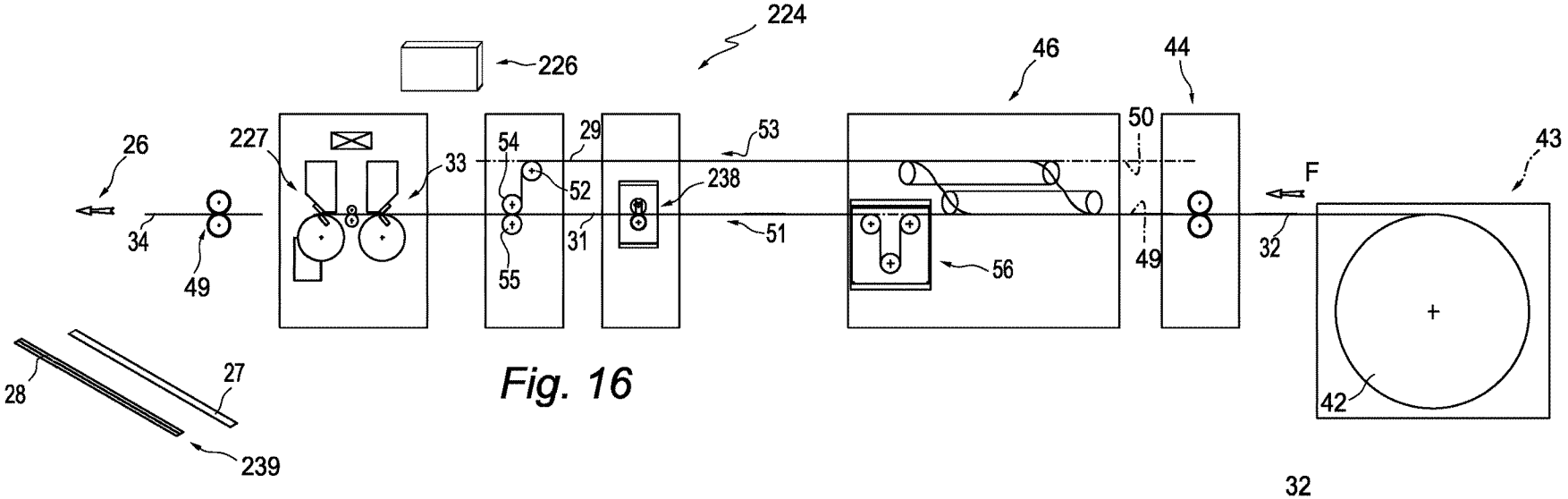
FIG. 16 is a schematic side view of a transversal cutting equipment for trimming strips, in accordance with a second example embodiment of the invention.
Figure 18:
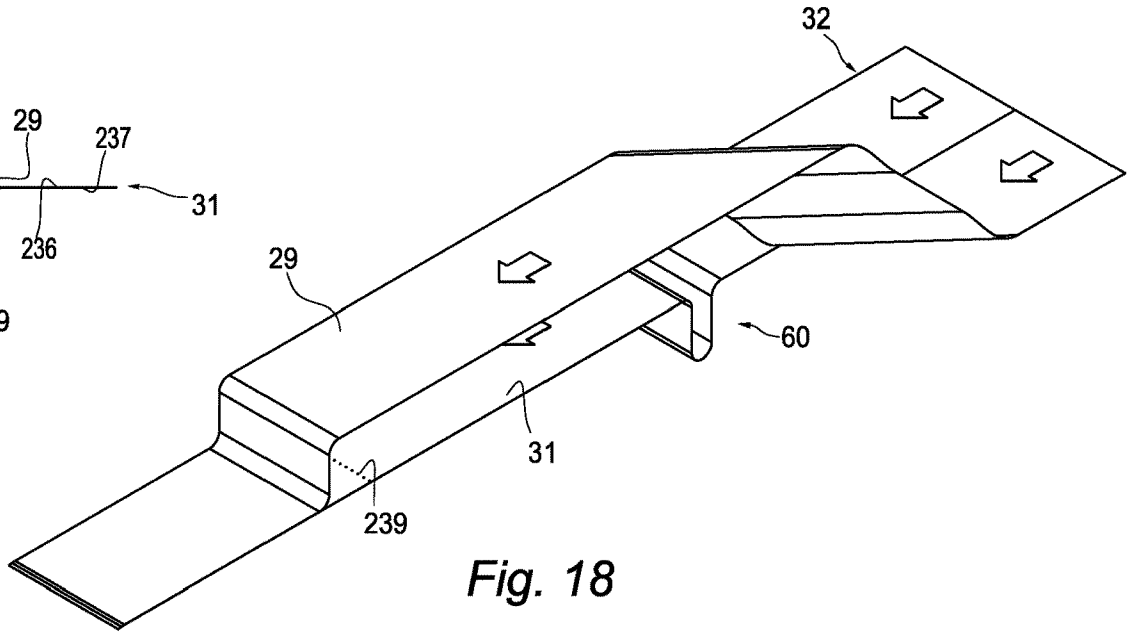
FIG. 18 is a schematic view of a part of the web treated by the transversal cutting equipment of FIG. 16.

FIG. 16 represents a transversal cutting equipment 224 for trimming strips of webs or continuous paper forms in movement, in accordance with a second example embodiment of the invention.

The equipment 224 is similar to transversal cutting equipment 24 of FIG. 1 and in which the components with the same function maintain the same numbering.

The cutting equipment 224 feeds the system 26 for the automatic processing of documents with the trimmed sheets 34 and is designated for cutting and separating the trimming strips 27 and 28 of the webs 29 and 31, respectively upper and lower, overlapped in adherence and obtained by longitudinal cutting and merging from a web 32 in movement.

The transversal cutting equipment 224 operates in association with the unwinding device 43 for the reel 42, with the longitudinal cutting device 44 and the deviating device 46 and is coordinated by an electronic control unit 226. Moreover, the equipment 224 operates in combination with the transversal cutting apparatus 33 for separating the basic overlapped sheets from the webs 29 and 31.

Also in this example embodiment of the invention, the deviating device 46 (FIG. 20) deviates and moves in height the web 29 with respect to the web 31 with support on the upper roller 52 along the deviated path 53, while the lower web 31 proceeds along the direct path 51. The lower roller 54 causes the web 29 to contact in overlapping the web 31 and the compensation mechanism 56 for the web 31 compensates for the differences in paths 51 and 53 as described for the transversal cutting equipment 24.

Figure 19:
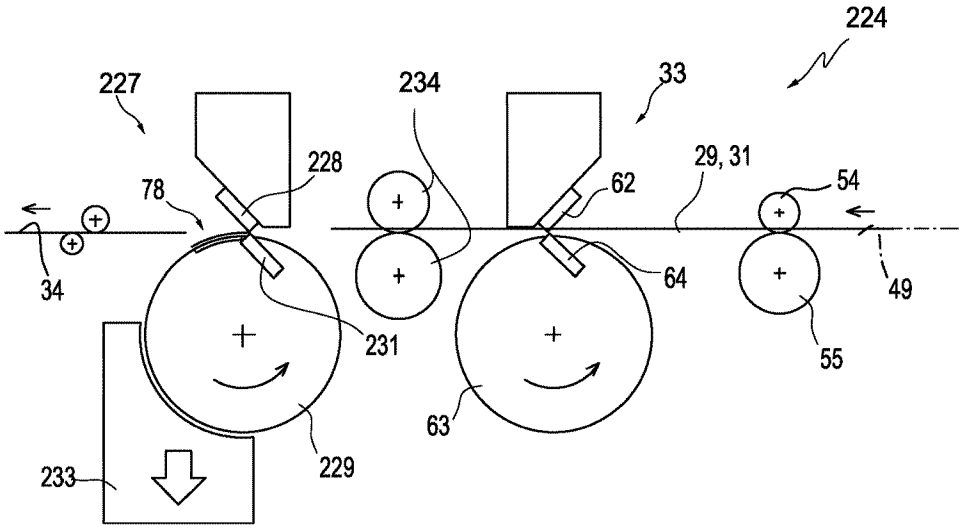
FIG. 19 shows a schematic section of some components of the cutting equipment for trimming strips of FIG. 16.

The cutting apparatus 33 (FIG. 19) comprises the fixed edge blade 62 and the edge blade carrying cylinder 63 with the movable edge blade 64 and in which the overlapped webs 29 and 31 follow a cutting path passing between the blade 62 and the cylinder 63. The rotation of the blade carrying cylinder 63 is in synchronism with the movements of the webs 29 and 31 and causes the cutting of the edges 40, 41 of the basic sheets 37*a* and 37*b* (see FIG. 4) under the control of the electronic unit 226.

For the separation of the strips (FIGS. 19 and 20), the transversal cutting equipment 224 includes, downstream of the cutting apparatus 33, a trimming apparatus 227, similar to the trimming apparatus 66, comprising a fixed trimming blade 228 and a trimming blade carrying cylinder 229, mounted for rotation about an axis of rotation of support for a movable trimming blade 231. Unlike the arrangement of the cylinder and trimming blade of the apparatus 66, the blade carrying cylinder 229 and the fixed trimming blade 228 of the trimming apparatus 227 are arranged below and, respectively, above the geometrical plane 49.

The trimming apparatus 227 (FIG. 20) also comprises the vacuum source 74, the compressed air source 76 and a strip collector 233. The trimming blade carrying cylinder 229 includes the retaining sector 78 and the axial duct 81. The retaining sector 78 is adjacent to the movable trimming blade 231 and has the series of suction openings 79 and the axial duct 81 and is connected, by means of the rotating shutter 82, to the vacuum source 74 or to the compressed air source 76 as a function of the angular position of the cylinder 72.

The strip collector 233 is arranged below the trimming blade carrying cylinder 229 and is connected to a vacuum source to collect the ejected trimming strips. The retaining sector 78 exercises the action of suction and retaining for a corresponding position adjacent to the position of cutting of the strip and the action of ejection for a position of the sector 78 in front of the strip collector 233.

Between the transversal cutting apparatus 33 and the trimming apparatus 227, the transversal cutting equipment 224 comprises two series of pairs of motorized pressure rollers 234. The rollers 234 maintain in adherence and draw the sheets separated after the cutting of the webs 29 and 31 by means of the blades 62 and 64 and in the passage between the fixed trimming blade 227 and the trimming blade carrying cylinder 229.

Figure 20:
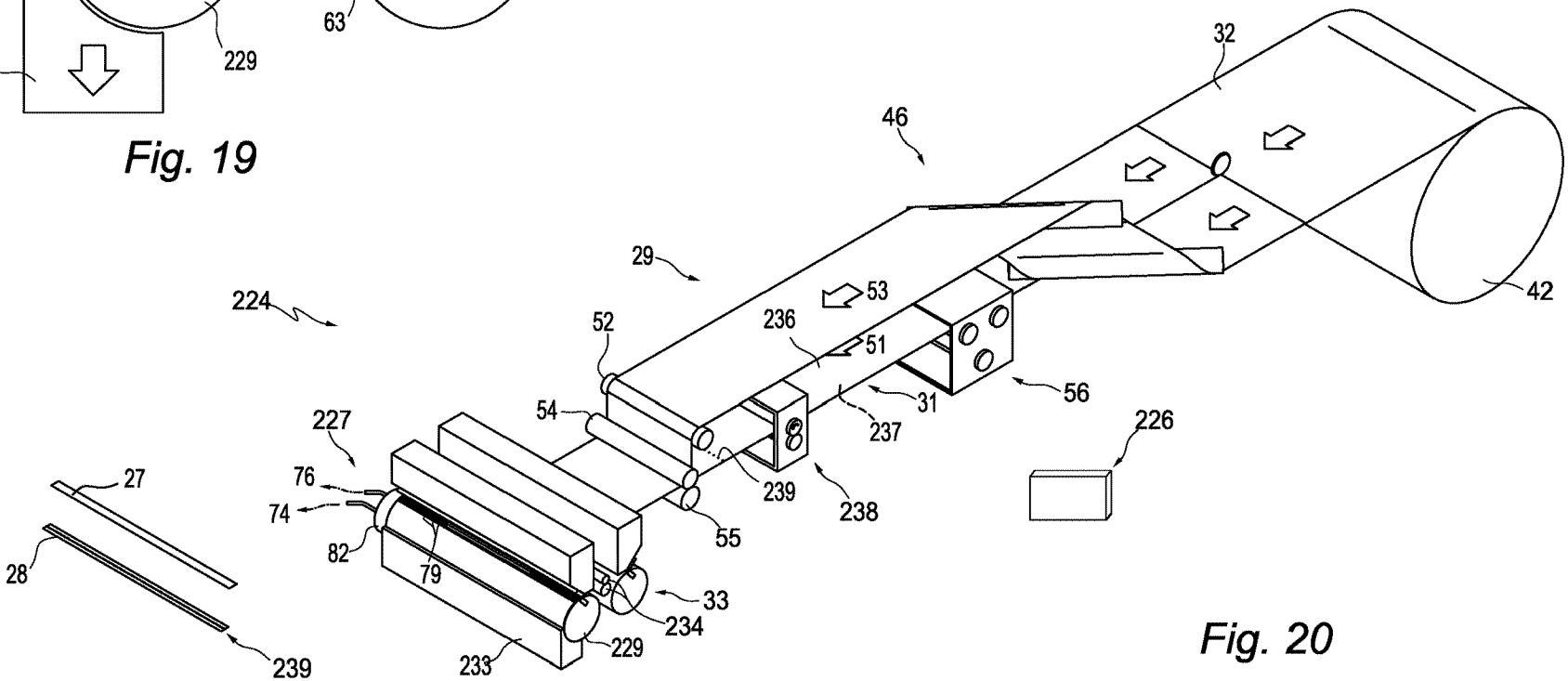
FIG. 20 shows a schematic view of the cutting equipment according to the second example embodiment of the invention.

In this example embodiment of FIG. 20, the lower web 31 has an upper face 236 adhering to the lower face 83 of the web 29 and an opposite face 237 facing the trimming blade carrying cylinder 229.

The transversal cutting equipment 224 is provided with a holing mechanism comprising a perforating device, here indicated by 238, having function similar to that of the perforating device 91. The perforating device 238 can be activated by the electronic control unit 226 to perform a row of transversal perforations 239 on the lower web 31 adjacent to the edge of separation of the sheets.

Figure 17:
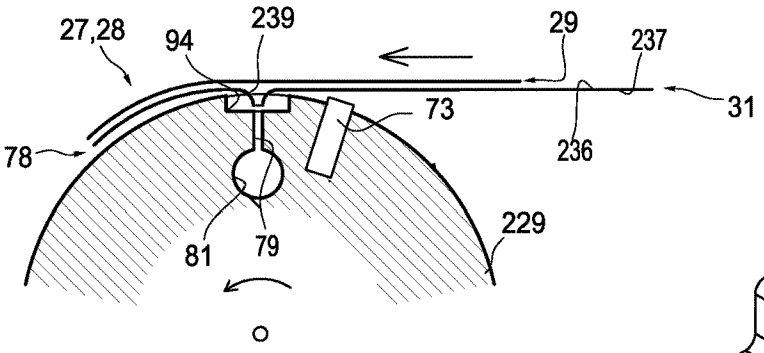
FIG. 17 is a sectional view, at an enlarged scale, of some details of the transversal equipment of FIG. 16.

In association with the trimming cutting, the strip 28 of the lower web 31 with the row of perforations 239 (FIG. 17) can be positioned in front of the longitudinal groove 94 of the cylinder 229 and the suction openings 79 of the retaining sector 78. The suction action on the strip of the lower web 31 is exerted also on the trimming strips 27 of the upper web 29 whereby keeping it adherent to the strip 31. The suction action on the strips 27 and 28 continues during the cutting and their dragging up to the collecting strip collector 233 and ceases with the ejection of the strips and the suction thereof by part of the collector 233.

Figure 21:
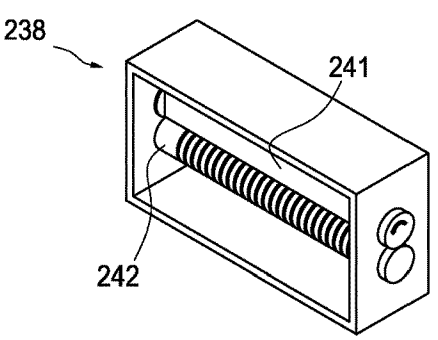
FIG. 21 is a schematic view of a component of the equipment of FIG. 20.

The perforating device 238 (FIGS. 20 and 21) is arranged along the direct path 51 of the web 31 and the perforating elements act on the face 236 for bends and burrs of the perforations 239 facing, in use, toward the groove 94 of the sector 78. In detail, the perforating device 238 includes, in vertical alignment, an upper tooth carrying support 241 and a lower contrast roller 242 with annular grooves, having functions similar to those of the tooth carrying support 96 and the contrast-roller 97 of the perforating device 91.

The transversal cutting equipment 224 can also provide the double perforations on the web 31 with devices similar to those of the equipment 24.

The strip cutting equipment of the invention, its components and the associated apparatuses may take other forms and variations. For example, in structures not shown, the perforation can be carried out downstream of the longitudinal cutting device 44, in the condition of longitudinal flanking of the webs 29 and 31.

As another variant, two deviating devices can be provided for obtaining the overlapped and offset in height condition of the webs 29 and 31 without any compensation mechanism. The webs 29 and 31 would be formed on a geometrical plane intermediate in height between the planes 49. A first deviating device provides to divert the web 29 upwards and to the left from the condition of flanking with the web 31 on the geometrical plane 50, whilst the second deviating device provides to divert the web 31 downwards and to the right from the condition of flanking with the web 29 on the geometrical plane 49, without any difference in the length of the deviated portion of the web. Also in this case the perforating device 91 would be partially arranged in the space between the planes 49 and 50. The other condition for the merging in overlapping of the webs 29 and 31 would be similar to the ones provided for the use of the deviating device 46 and the compensating mechanism 56.

Naturally, the principle of the invention remaining the same, the example embodiments and the details of construction of the equipment of cutting for trimming strips and the respective method can broadly be varied with respect to what has been described and illustrated, by way of non-limitative example, without by this departing from the ambit of the present invention.

We claim:

1. A cutting apparatus comprising:

a transversal cutting equipment for trimming strips of webs moving along a given direction, the transversal cutting equipment comprising:

a trimming apparatus including:

a stationary fixed trimming blade, and a trimming blade carrying cylinder supporting a movable trimming blade and rotatably mounted around a rotating axis;

a vacuum source;

a strip collector; and a separating transversal cutting device;

wherein said trimming apparatus is disposed downstream from the separating transversal cutting device and operates in association with the separating transversal cutting device for executing transversal cuts on said webs defining basic sheets with respective transversal separation edges, wherein the movable trimming blade is provided for cooperating with the fixed trimming blade for separating transversal strips of the webs adjacent to the transversal separation edges, the trimming blade carrying cylinder includes a retaining sector adjacent to the movable trimming blade, wherein said retaining sector defines a plurality of suction openings connected to the vacuum source for retaining the strips by suction and dragging the strips up to the strip collector, wherein said equipment is used for cutting and separating transversal strips of two said webs overlapped in adherence jointly to form the basic sheets which are overlapped; and wherein said equipment further comprises a holing mechanism arranged upstream from the separating transversal cutting device for effecting holes transversely on one of the two webs and an electronic control unit for the trimming blade carrying cylinder and the holing mechanism, wherein, in use, the two webs overlapped in adherence are moved between the trimming blade carrying cylinder and the fixed trimming blade and include a first web and a second web of which the first web faces towards the trimming blade carrying cylinder and the second web faces towards the fixed trimming blade;

wherein the holing mechanism is actuatable by the electronic control unit for forming a row of holes transversely to the first web, adjacent to each of the transversal separation edges, in order to position said row of holes on the first web close to the suction openings of the retaining sector of the trimming blade carrying cylinder in association with the cutting of the strips for a suction action on the second web; and wherein the suction action is such as to retain overlapped and in adherence on the retaining sector the strip of the first web and the strip of the second web in adherence on the strip of the first web during the cutting and the dragging of the strips up to the strip collector.

2. The cutting apparatus according to claim 1, wherein the trimming blade carrying cylinder defines a longitudinal groove on the retaining sector and wherein the suction openings are arranged along said groove for causing the row of holes, in operative conditions, to be substantially aligned with said groove.

3. The cutting apparatus according to claim 2, wherein said groove has a width of 2-4 mm and a depth of 0.1-0.8 mm.

4. The cutting apparatus according to claim 2, wherein the first web defines an adherence surface that, in said use, faces toward the second web, the holing mechanism comprises a perforating device operating with perforating elements, wherein said perforating elements are provided for acting on the first web in order to effect said row of holes as transversal perforations with bends and burrs extending from the adherence surface of the first web and directed toward the groove of the retaining sector.

5. The cutting apparatus according to claim 4, wherein the perforating device includes a tooth carrier and a contrast roller, said tooth carrier and said contrast roller are rotatably mounted on respective parallel rotation axes transversely to the given direction and define a passage space for the first web, wherein said perforating elements comprise a row of perforating teeth mounted on said tooth carrier, said row of perforating teeth is arranged along a direction transversal with respect to said given direction, and wherein said tooth carrier is rotated by a servomechanism controlled by the electronic control unit for executing, on the fly, the transversal perforations of the first web at predetermined distances from the separation edges along said given direction.

6. The cutting apparatus according to claim 5, wherein the perforating teeth are made from a blade of 1.0-2.5 mm of thickness with a pitch of about 3-5 mm and a width of the teeth at the base of 2.0-3.5 mm, for perforations of quadrangular shape of 0.8 to 1.5 mm and pitch of 3-5 mm.

7. The cutting apparatus according to claim 5, wherein the contrast roller defines annular grooves for receiving the row of perforating teeth.

8. The cutting apparatus according to claim 1, wherein the holing mechanism comprises a perforating device for forming micro-perforations comprising:

a support having a series of teeth distributed in rows and columns, and a contrast roller for receiving said teeth, and wherein said support having the teeth is servo-controlled by the electronic unit for executing, on the fly, transversal micro-perforations on the first web moving at a given speed, while the contrast roller is driven for rotating with a peripheral speed synchronous with the given speed of said first web.

9. The cutting apparatus according to claim 8, wherein the teeth for the micro-perforations are formed of 4-5 juxtaposed blades of 0.3 mm of thickness, alternated with blades without teeth of the same thickness, in groups of 4-6 teeth, and a pitch of about 15 mm, for micro-perforations of about 0.2×0.6 mm, in areas of about 2.5×6.0 mm and a pitch of 15 mm.

10. The cutting apparatus according to claim 1, wherein said equipment is downstream from a group which includes a longitudinal cutting device and a deviating device, wherein said equipment obtains the two webs as a result of a longitudinal cut of a continuous form by the longitudinal cutting device and deviation of the two webs by the deviating device along a first path and a second path, wherein the first path and the second path are overlapped and offset in height and wherein the holing mechanism operates along the first path or, alternatively, along the second path.

11. The cutting apparatus according to claim 10, further comprising a height deflection mechanism and a compensation mechanism, wherein the height deflection mechanism is provided for positioning one of the two webs in an overlapped and adherence condition with the other of the two webs, and the compensation mechanism is operative on the other of the two webs for compensating the difference in length between the first path and the second path before the overlapped and adherence condition.

12. The cutting apparatus according to claim 1, wherein said equipment is downstream from a group which includes a longitudinal cutting device and a deviating device, said longitudinal cutting device and said deviating device together form the first web and the second web as a result of longitudinal cutting from a continuous form to form the first and second webs in a side by side condition and a following deviation to an overlapped and offset in height condition of the first web and the second web, and wherein said longitudinal cutting unit operates on the first web.

13. The cutting apparatus according to claim 1, wherein said row of holes is a first row of holes and wherein said holing mechanism is configured to form a second row of holes transversely on the first web, and wherein the second row of holes is adjacent to the first row of holes and can be positioned in front of the suction openings on the retaining sector of the trimming blade carrying cylinder for an extended suction action on the second web.

14. The cutting apparatus according to claim 1, wherein said row of holes is a first row of holes and wherein the cutting equipment is configured to provide a double actuation of the holing mechanism for perforating a second row of holes on the first web, and wherein the second row of holes is adjacent to the first row of holes and can be positioned close to the suction openings on the retaining sector of the trimming blade carrying cylinder for an extended suction action on the second web.

15. The cutting apparatus according to claim 1, wherein said separating transversal cutting device includes:

a stationary fixed edge blade, and an edge blade-carrying cylinder with a movable edge blade; and wherein the separating transversal cutting device is arranged upstream of the trimming apparatus with respect to the given direction of movement of the two webs for separating the overlapped basic sheets, wherein said holing mechanism is positioned upstream of the separating transversal cutting device, and wherein, in said use, the two overlapped webs follow a cutting path passing between the fixed edge blade and the edge blade-carrying cylinder of the separating transversal cutting device and between the fixed trimming blade and the trimming blade carrying cylinder of the trimming apparatus.

16. A transversal cutting equipment for trimming strips of webs moving along a given direction, comprising:

a trimming apparatus including:

a stationary fixed trimming blade, and a trimming blade carrying cylinder supporting a movable trimming blade and rotatably mounted around a rotating axis;

a vacuum source;

a strip collector; and a separating transversal cutting device;

wherein said trimming apparatus is disposed downstream from the separating transversal cutting device and operates in association with the separating transversal cutting device for executing transversal cuts on said webs to define basic sheets with respective transversal separation edges, wherein the movable trimming blade is configured to cooperate with the fixed trimming blade for separating transversal strips of the webs adjacent to the transversal separation edges, wherein the trimming blade carrying cylinder comprises a retaining sector adjacent to the movable trimming blade, wherein said retaining sector defines a plurality of suction openings connected to the vacuum source for retaining the strips by suction and dragging the strips up to the strip collector, and wherein said equipment is used for cutting and separating the transversal strip of each of two said webs overlapped in adherence jointly to form the basic sheets which are overlapped; and wherein said equipment further comprises a holing mechanism arranged upstream from the separating transversal cutting device for effecting holes transversely on one of the two webs and an electronic controller for the trimming blade carrying cylinder and the holing mechanism, wherein, in use, the two webs overlapped in adherence are moved between the trimming blade carrying cylinder and the fixed trimming blade and include a first web and a second web of which the first web faces towards the trimming blade carrying cylinder and the second web faces towards the fixed trimming blade, wherein the holing mechanism is actuatable by the electronic controller for forming a row of said holes transversely to the first web, adjacent to each of the transversal separation edges, wherein the holing mechanism is controlled to form said row of holes, on the one of said two webs close to the suction openings of the retaining sector in association with the cutting of the strips, for permitting a suction action on the second web, and wherein the suction action is such as to retain, overlapped and in adherence on the retaining sector, the strip of the first web and the strip of the second web during the cutting and the dragging of the strips up to the strip collector.

17. The cutting equipment according to claim 16, wherein the trimming blade carrying cylinder defines a longitudinal groove on the retaining sector and wherein the suction openings are arranged along said groove for causing the row of holes, in operative conditions, to be substantially aligned with said groove.

18. The cutting equipment according to claim 16, wherein the holing mechanism comprises:

a perforating device for forming micro-perforations comprising:

a support having a series of teeth distributed in rows and columns, and a contrast roller for receiving said teeth, wherein said support having the teeth is servo-controlled by the electronic controller for executing, on the fly, transversal micro-perforations on the first web moving at a given speed, while the contrast roller is driven for rotating with a peripheral speed synchronous with the given speed of said first web.

* * * * *